US006198897B1

(12) United States Patent
Ream

(10) Patent No.: US 6,198,897 B1
(45) Date of Patent: Mar. 6, 2001

(54) METHOD AND APPARATUS FOR CORRECTING TRANSFER BELT POSITION VIA STORED PARAMETERS

(75) Inventor: Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/398,617

(22) Filed: Sep. 17, 1999

(51) Int. Cl.[7] ..... G03G 15/01
(52) U.S. Cl. ..... 399/301; 399/121
(58) Field of Search ..... 399/121, 302, 399/308, 313, 165, 94, 36, 12, 109, 301

(56) References Cited

U.S. PATENT DOCUMENTS

| | | | | |
|---|---|---|---|---|
| 4,462,676 | * | 7/1984 | Shimura et al. | 399/165 |
| 4,577,953 | * | 3/1986 | Narukawa | 399/36 |
| 4,912,512 | | 3/1990 | Midorikawa et al. . | |
| 5,091,654 | | 2/1992 | Coy et al. . | |
| 5,252,838 | | 10/1993 | Timblin . | |
| 5,272,503 | | 12/1993 | LeSueur et al. . | |
| 5,278,625 | | 1/1994 | Charnitski et al. . | |
| 5,287,162 | | 2/1994 | De Jong et al. . | |
| 5,291,392 | | 3/1994 | Gerber et al. . | |
| 5,325,154 | | 6/1994 | Tayama et al. . | |
| 5,394,222 | * | 2/1995 | Genovese | 399/165 X |
| 5,452,073 | | 9/1995 | Kataoka . | |
| 5,555,084 | | 9/1996 | Vetromile et al. . | |
| 5,587,783 | | 12/1996 | Nakamura et al. . | |
| 5,732,162 | | 3/1998 | Curry . | |
| 5,768,671 | | 6/1998 | Komiya et al. . | |
| 5,784,676 | * | 7/1998 | Iseki et al. | 399/165 X |
| 5,903,805 | * | 5/1999 | Ueda et al. | 399/165 |

FOREIGN PATENT DOCUMENTS

| | | | |
|---|---|---|---|
| 2-304465 | * | 12/1990 | (JP) . |
| 3-230172 | * | 10/1991 | (JP) . |
| 4-149479 | * | 5/1992 | (JP) . |
| 9-54476 | * | 2/1997 | (JP) . |
| 10-133448 | * | 5/1998 | (JP) . |
| 10-213943 | * | 8/1998 | (JP) . |
| 11-202576 | * | 7/1999 | (JP) . |

* cited by examiner

*Primary Examiner*—Susan S. Y. Lee
(74) *Attorney, Agent, or Firm*—Michael T. Sanderson

(57) ABSTRACT

A method and apparatus for correcting transfer belt positioning error in printers. A transfer belt subassembly includes a transfer belt, a plurality of rollers, and a storage device. The transfer belt also includes a home position indicator. The subassembly is measured and characterized before being installed in a printer. The measurement and calibration data for the transfer belt is stored in the storage device. When the transfer belt assembly is inserted into a printer, a controller within the printer is placed in communication with the storage device. A sensor is used to determine the home position of the belt from the indicator, and a resulting signal indicating the belt is at the home position is provided to the controller. The controller utilizes the measurement and calibration data from the storage device to control the motor to correct for belt positioning errors. In such a manner, the calibration data is predetermined before the belt assembly is inserted into the printer, thereby eliminating the need for calibration cycles after the belt assembly has been installed within the printer, while providing a high degree of alignment of the color planes onto the transfer belt.

24 Claims, 3 Drawing Sheets

METHOD AND APPARATUS FOR CORRECTING TRANSFER BELT POSITION VIA STORED PARAMETERS

BACKGROUND OF THE INVENTION

A frequent problem associated with color printers is misregistration or misalignment of one or more color planes. Alignment of the color planes is crucial in achieving a high quality image. The color planes are sequentially deposited onto a transfer medium such as an intermediate transfer belt that is used to transfer the color planes to medium such as a piece of paper. Alternately the medium itself may be transported and have the color planes sequentially deposited directly thereon.

Due to the fact that each individual color plane is transferred onto the belt or print medium at different locations along the travel path of the belt or print medium, the belt position within the travel path must be known or predicted with a high degree of precision. The position of the belt must be known to insure that the resulting image is of good quality.

There are many instances where belt positioning errors develop and cause a concomitant degradation in the resulting image. Drive roller runout, variations in the thickness of the belt, drive roller cylindrical imperfections, and variations in the belt tension are, in general, examples of factors that lead to belt positioning errors. In particular, the surface velocity of the belt is caused to run slower or faster depending upon whether: i) the belt is thin or thick as the belt passes over the drive roll; ii) the radius of the drive roller is longer or shorter as the belt passes over; and iii) the belt is tightly or loosely tensioned.

Others have tried to compensate for belt position errors by performing a calibration cycle within the printer at periodic intervals. The calibration cycle generates a test pattern from each color head to the transfer belt (typically toned line segments or symbols), detects the image position on the belt by way of a complex sensor, and corrects for belt speed or position based on the detected image. This manner of correcting for belt positioning to implement in the printer, wastes toner, and consumes time each occasion the calibration cycle is run. It would be desirable to have a method and apparatus that corrects for belt positioning errors which is inexpensive to implement in a printer, does not require user calibration, and does not add complexity to the printer.

BRIEF SUMMARY OF THE INVENTION

A method and apparatus for correcting transfer belt positioning error in printers is disclosed. A transfer belt subassembly includes a transfer belt, a plurality of rollers, and a storage device. The transfer belt also includes a home position indicator. The transfer belt subassembly is measured and characterized relative to the home position indicator before being installed in a printer. The measurement and calibration data for the transfer belt is then stored in the storage device that is part of the transfer belt subassembly. When the transfer belt subassembly is inserted into a printer, a controller within the printer is placed in communication with the storage device. A sensor is used to determine the home position of the belt from the indicator, and a resulting signal indicating when the belt is at the home position is provided to the controller. The controller utilizes the measurement and calibration data from the storage device to control the belt drive motor and print heads to correct for belt positioning errors. In such a manner, the calibration data is predetermined before the belt assembly is inserted into the printer, thereby simplifying the printer composition and eliminating the need for calibration cycles after the belt assembly has been installed within the printer. By use of the calibration and measurement data, precise alignment of the color planes onto the transfer belt or print medium is achieved.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Image forming apparatus, such as color printers, sometimes utilize a transfer belt assembly to accumulate an image from a plurality of color planes. The color planes are placed onto the belt in succession as the transfer belt passes by the photoconductive (PC) drum, or other similar electrophotostatic devices, associated with each color print head. Once the belt has traversed all of the PC drums a resulting image, which will later be transferred to a print medium, is provided on the transfer belt. Alternately the transfer belt is used to transport a piece of print medium, such as paper, card stock or transparencies, and the color planes are deposited directly on the print medium as the medium passes by the PC drums of each color station.

Figure 1:
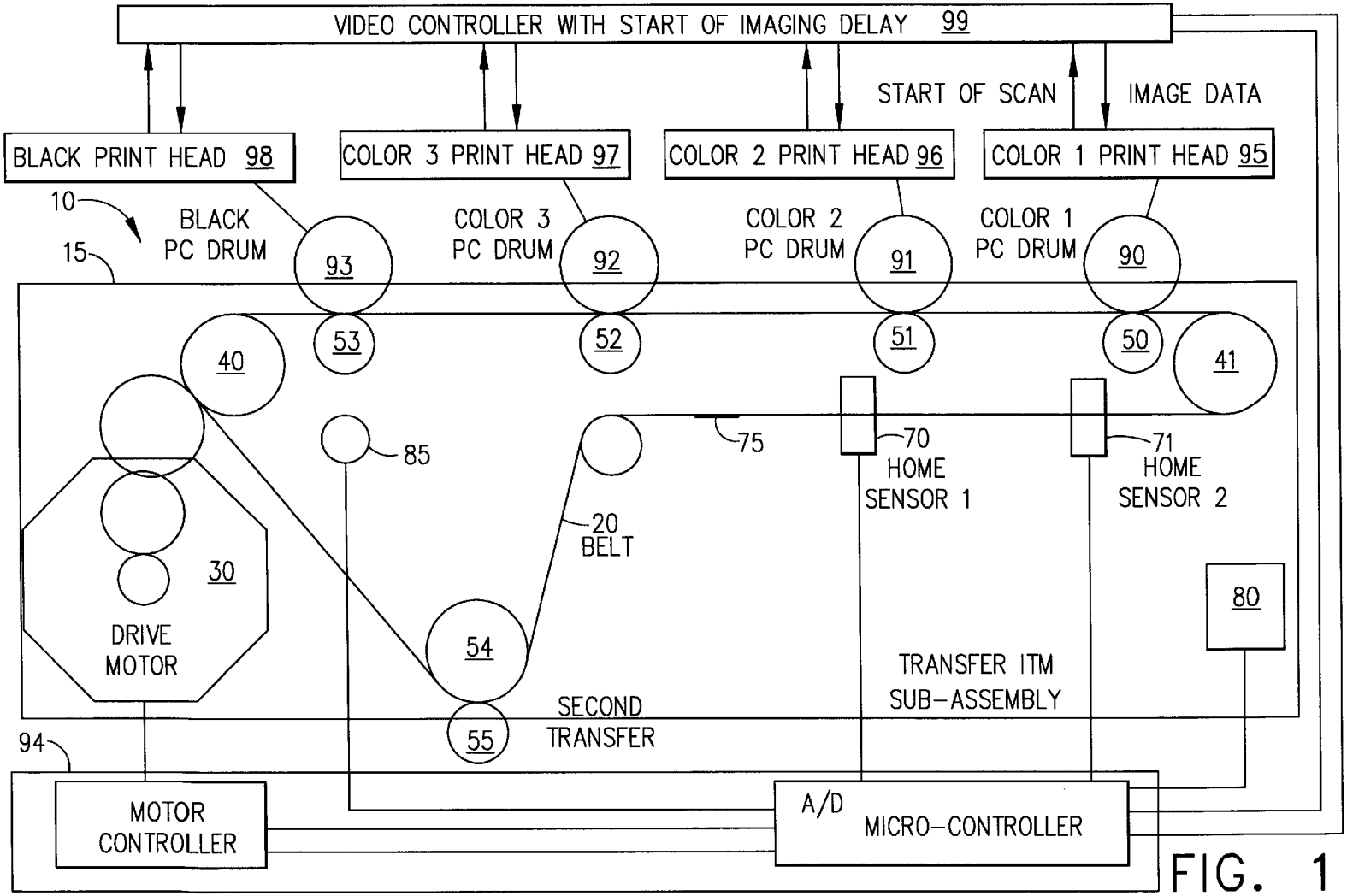
FIG. 1 is a schematic diagram illustrating a first embodiment of the apparatus of the present invention.

Referring to FIG. 1, an apparatus 10 for providing transfer belt correction is shown. The apparatus 10 includes transfer belt subassembly 15, a drive motor 30 and a controller 94. The transfer belt subassembly 15 contains a transfer belt 20, a first home position sensor 70, a second home position sensor 71, a temperature sensor 85 such as a thermistor, a memory device 80 and a plurality of rollers. While the presently described embodiment includes a belt movable about transfer rollers, other embodiments may include a movable platen wherein the color planes are transferred onto the platen. The plurality of rollers include a drive roller 40, an end roller 41, a first transfer roller 50, a second transfer roller 51, a third transfer roller 52, a fourth transfer roller 53, and an accumulated image transfer roller 55.

The transfer belt 20 surrounds and traverses an ellipsoidal path defined by rollers 40, 41 and 54. The transfer belt 20 also includes a home position indicator 75 that is useful for accurately identifying a specific position of the transfer belt 20 with respect to the transfer belt subassembly 15.

Roller 40 is used as a drive roller and is in mechanical communication with a drive motor 30 as will be described below. Roller 40 thus provides for movement of the transfer belt 20 through the belt path.

Transfer rollers 50, 51, 52 and 53 are used to aid in the transfer of color planes from respective PC drums onto the transfer belt 20. While four color planes are described in this embodiment, it should be understood that any number of color planes and associated PC drums and transfer rollers travels over first transfer roller 50, a first color plane is deposited onto the transfer belt by being placed in contact with a first PC drum 90. As the same area of the belt further traverses the belt path a second color plane is transferred onto the transfer belt by being placed in contact with a second PC drum 91 opposite second transfer roller 51. The second color plane is deposited overlaying the first color plane. As the area of the belt 20 continues to traverse further along the travel path, a third color plane is deposited over the first and second color planes by being placed in contact with a third PC drum 92 and third transfer roller 52. As the area of the belt 20 continues further along the travel path, a fourth color plane is deposited over the first, second and third color planes by being placed in contact with a fourth PC drum 93 and fourth transfer roller 53. The accumulated image is then transferred to a print medium (not shown) by transfer roller 55. The print medium may comprise paper, card stock, transparencies or the like.

Figure 2:
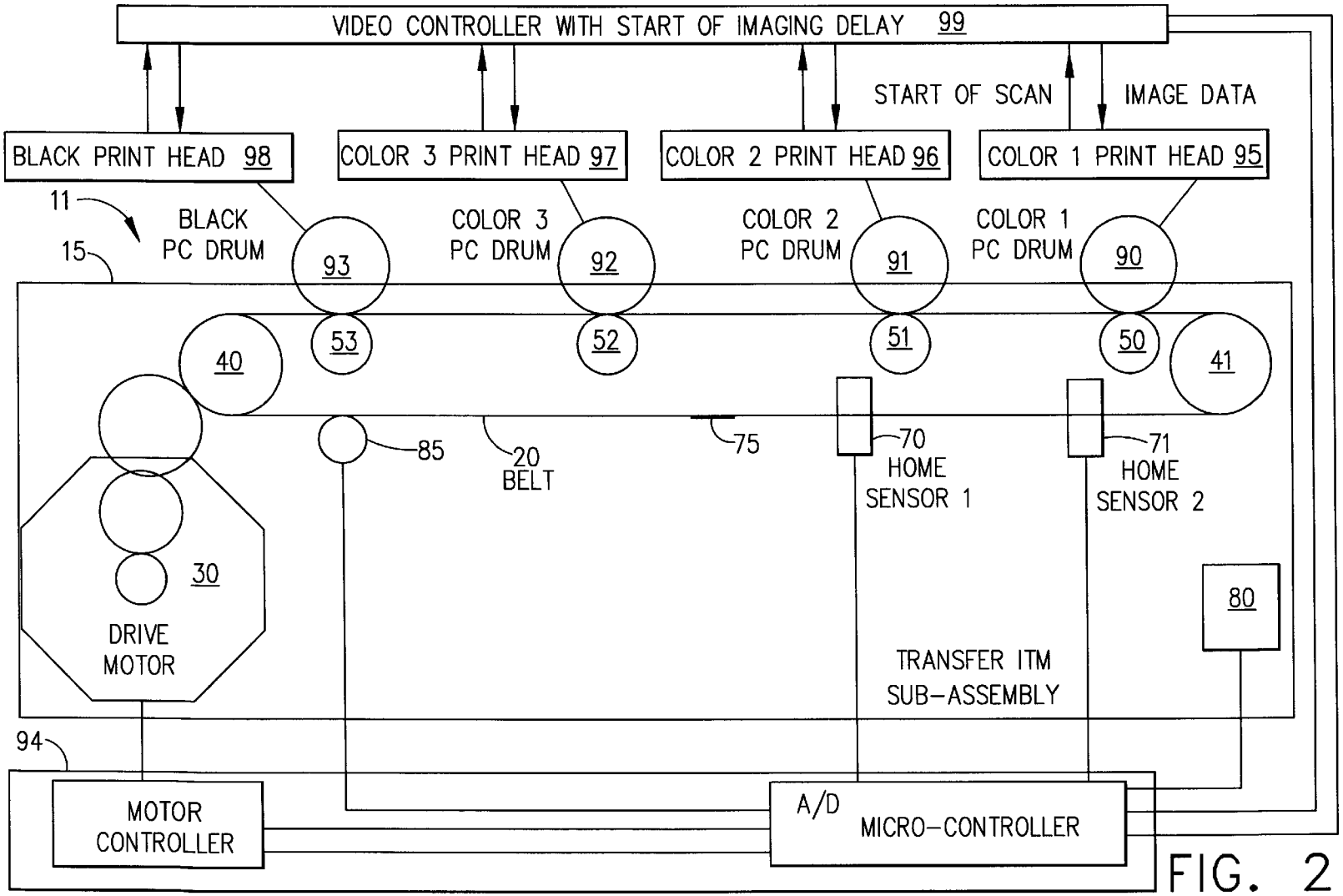
FIG. 2 is a schematic diagram illustrating a second embodiment of the apparatus of the present invention.

Referring to FIG. 2, a second embodiment of an apparatus 11 for providing transfer belt correction is shown. The apparatus 11 is similar to the apparatus disclosed in FIG. 1, except that the color planes are deposited directly onto a print medium disposed on and transported by the transfer belt.

In this embodiment the transfer rollers 50, 51, 52 and 53 are used to aid in the transfer of color planes from respective PC drums directly onto the print medium. As an area of the transfer belt 20 travels over first transfer roller 50, a first color plane is deposited onto the print medium by being placed in contact with a first PC drum 90. As the same area of the belt further traverses the belt path a second color plane is transferred onto the print medium by being placed in contact with a second PC drum 91 opposite second transfer roller 51. The second color plane is deposited overlaying the first color plane. As the area of the belt 20 continues to traverse further along the travel path, a third color plane is deposited over the first and second color planes by being placed in contact with a third PC drum 92 and third transfer roller 52. As the area of the belt 20 continues further along the travel path, a fourth color plane is deposited over the first, second and third color planes by being placed in contact with a fourth PC drum 93 and fourth transfer roller 53.

Alignment of the color planes on the transfer belt or medium is crucial for providing a high quality resulting image. There are a number of factors that affect the alignment of the color planes on the transfer belt or medium. For example, the rollers can have various amounts of runout, there may be variations in the width or thickness of the belt, and there may be variations in the tension of the belt along the belt path. In the second embodiment, the print medium may move with respect to the transfer belt.

In order to provide for proper alignment of the color planes, the transfer belt subassembly 15 is measured and characterized in a special test fixture with simulated loads at the time the subassembly 15 is manufactured. This applies to the transfer belt subassembly 15 of either of the embodiments shown in FIGS. 1 and 2. An AC belt surface velocity relative to the home position indicator 75 is recorded. This measurement may be obtained by use of a calibrated surface wheel/tachometer in non-slip contact with the transfer belt near the drive roller. An average or DC belt surface velocity is also measured by recording the transfer belt transition time between the first home sensor 70 and the second home sensor 71. The distance between the first home sensor 70 and second home sensor 71 is preferably equal to the distance between adjacent PC drums. The DC belt surface velocity may also be measured by use of a calibrated surface wheel/tachometer in non-slip contact with the transfer belt near the drive roller. A temperaturesensing element such as a thermistor measures the temperature on or near the drive roller. The measured temperatures are used to compensate for thermal variations of the printer components. The AC belt lateral position is measured at each color station and optionally at the transfer station. The measurements are made relative to a known or learned belt edge profile and are obtained by, for example, a photo-electric sensor.

The data that reflects the measured and characterized transfer belt subassembly 15 is stored in a storage device 80, which is part of the belt subassembly 15. The stored data includes, but is not limited to, the belt length, defined in zones, which is used for velocity control of the belt, the belt length, defined in zones, for start-of-imaging control for the respective print heads, and the belt DC travel time between the first home sensor 70 and the second home sensor 71 with respect to temperature. Additionally, the stored data includes the time between sensors with AC feed-forward, the travel time between sensors without AC feed-forward, different function enables for the printer, the AC belt velocity correction table, and belt start of scan delay correction tables for three of the color stations with respect to the fourth color station. Alternatively, scan correction tables for all four color stations with respect to position at another reference such as a second transfer to the print media.

The storage device 80 may be a semiconductor memory such as a DS1985 non-volatile 16 Kbit memory available from Dallas Semiconductor Corp. of Dallas, Tex. The stored data is also referred to as calibration data.

The home position indicator 75 of the transfer belt 20 provides a reference point for the measurement and calibration data. As such, the calibration data is in some manner associated with the home position indicator. For example, since the belt length and surface velocity are known, by measurement, a precise distance on the belt away from the home position indicator may be determined by sensing the home position indicator and then by measuring elapsed time. Other such examples can be deduced from the foregoing description.

As for a physical embodiment of the home position indicator, the indicator 75 may be realized as a notch or a hole punched in the transfer belt 20 or as indicia printed, adhered, painted, etc., on the belt. The indicator 75 may also be realized as a magnetic or an electrostatic device. While the first and second home position sensors 70, 71 are shown as part of the transfer belt subassembly 15 in this embodiment, the home position sensors 70, 71 could also be located external to the subassembly 15. The home position sensors 70, 71 must be able to detect the presence of the home position indicator 75. Thus, when the home position indicator 75 comprises a hole punched in the transfer belt 20, an optical sensor may be used to detect the presence of the hole. When painted, adhered, or printed indicia are used to indicate the home position a reader must be used to sense the presence of the indicia. Similarly, when a magnetic or electrostatic device is used as the home position indicator a sensor sensitive to the magnetic or electrostatic device is used to determine the presence of the home position indicator 75.

The subassembly 15, after having its measurement and calibration data determined and stored in memory, is installed in a printer. The data from the subassembly storage device 80 is utilized by the controller 94 of the printer to control the motor 30 to correct the belt speed or belt position based on the previously stored measurement and calibration data in accordance with a pre-programmed algorithm which interprets the parametric correction data from the storage device 80. In response to the home position sensors 70, 71 detecting the home position indicator 75, and the data in the memory 80, the controller 90 produces a signal that modulates the speed of the drive motor 30. The drive motor 30 may be a brushless D.C. motor with encoder feedback, a brush D.C. motor with encoder feedback, a stepper motor, or a stepper motor with encoder feedback. The drive motor 30 drives the drive pulley 40 to provide movement of the transfer belt 20 around the belt path in accordance with the measurement and calibration data. Additionally, the start-of-scan delay for each color print head 95–98 is determined in order to provide for lateral alignment of the deposited color planes. Accordingly, the registrations of the various color planes transferred to the transfer belt 20 are precise, resulting in the production of a high quality image.

In a preferred embodiment, the transfer belt subassembly 15 is a field replaceable unit. That is to say that the subassembly is a self-contained unit within an image forming apparatus that may be replaced independently of other subassemblies of the apparatus, such as the cartridges, for example. As such, a worn transfer belt subassembly 15 can be easily replaced with another subassembly that also has its own stored calibration data. The printer can use the new subassembly without the need to be recalibrated while still providing a high quality image.

Figure 3:
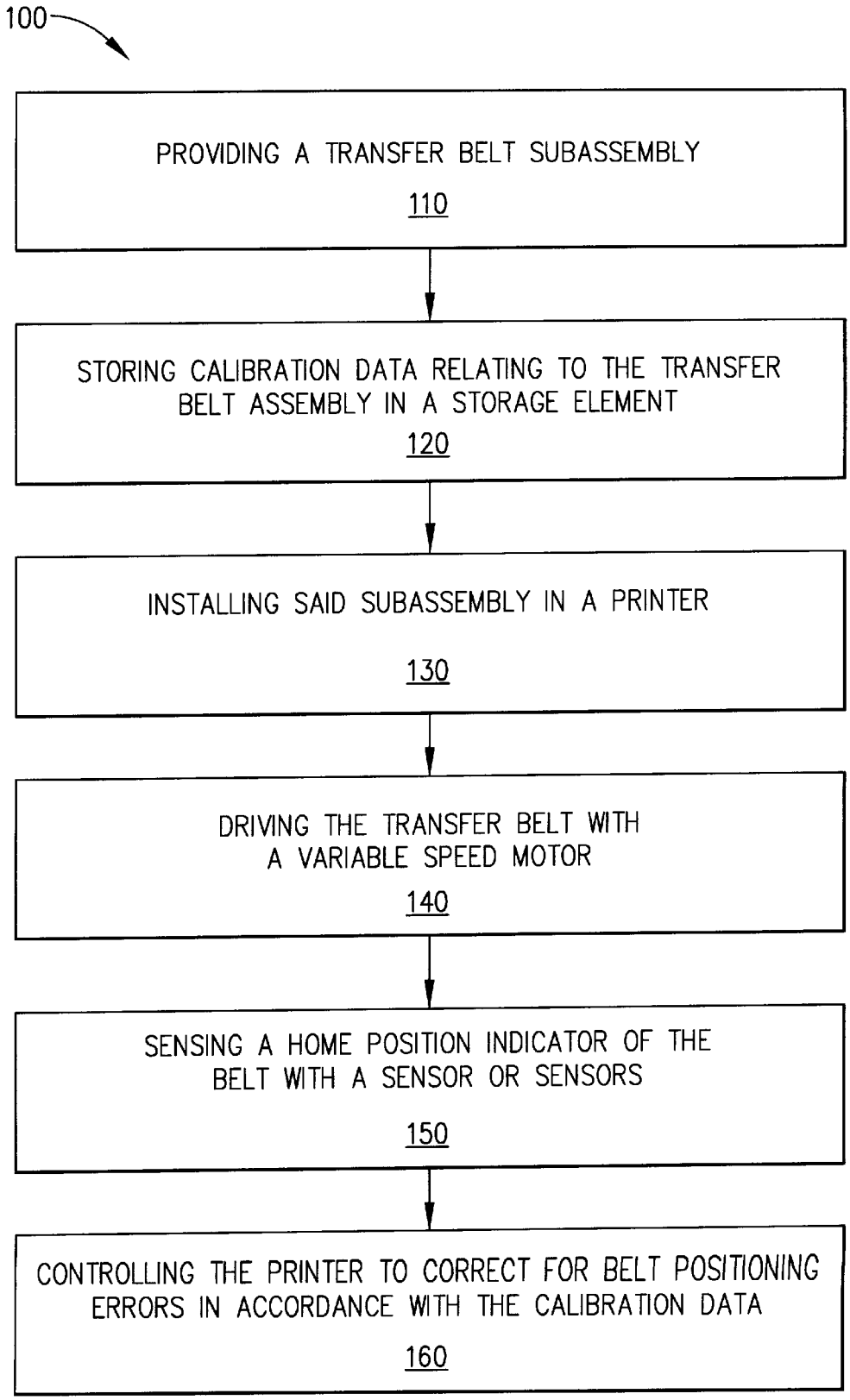
FIG. 3 is a flow chart illustrating the method of the present invention.

Referring now to FIG. 3, a flowchart showing a method 100 of providing transfer belt correction is provided. A first step 110 of the method comprises providing a transfer belt subassembly. The subassembly is manufactured and assembled as a separate field-replaceable unit.

During the next step 120, calibration data relating to the transfer belt subassembly is obtained and stored in a memory. The memory is a non-volatile memory which is included as part of the subassembly. The calibration data is preferably of the type previously described.

The next step 130 comprises installing the subassembly into a printer. The installation could be into a new printer or as a replacement for a worn subassembly.

At step 140 a variable speed motor drives the transfer belt of the subassembly. The motor engages a drive pulley of the subassembly that in turn causes the transfer belt to traverse along the belt path.

At the following step 150, a sensor or sensors detect the home position indicator of the belt. This provides a reference point for the calibration data with respect to the transfer belt.

At step 160 the belt positioning is controlled by a controller which provides a signal in response to the detection of the home position indicator by the sensor or sensors and the calibration data from the memory. As such, the calibration data is used dynamically to correct for belt positioning errors of the subassembly according to the particular characteristics of the subassembly.

By way of the above described apparatus and method, errors associated with transfer belt positioning are removed or significantly reduced. The complexity, cost, measurement time and toner waste associated with measuring and characterizing the assembly within the printer are eliminated. By including the memory device as part of the transfer belt subassembly, the transfer belt subassembly can be removed and a replacement installed without having to recalibrate the printer, while maintaining highly precise color plane registration on the transfer belt.

Having described preferred embodiments of the present invention it should be apparent to those of ordinary skill in the art that other embodiments and variations of the presently disclosed embodiment incorporating these concepts may be implemented without departing from the inventive concepts herein disclosed. Accordingly, the invention should not be viewed as limited to the described embodiments but rather should be limited solely by the scope and spirit of the appended claims.

What is claimed is:

1. An image forming apparatus which provides transfer belt position correction, said image forming apparatus comprising:

a removable transfer belt subassembly containing a transfer belt for receiving an image thereon;

a home position indicator associated with said transfer belt;

a non-volatile memory storage device having calibration data stored thereon regarding said transfer belt, said calibration data being associated with said home position indicator, said memory storage device being mounted on said transfer belt subassembly;

at least one sensor for sensing said home position indicator; and a controller that utilizes said stored calibration data and signals from said at least one sensor to control positioning of said transfer belt such that, upon installation of said transfer belt subassembly into said image forming apparatus, said controller relies on said calibration data to effectively correct errors in the positioning of said transfer belt without undergoing any belt calibration cycle to generate a test pattern.

2. The apparatus of claim 1 further comprising:

a variable speed motor for driving said transfer belt.

3. The apparatus of claim 1, wherein said transfer belt correction aligns a plurality of color planes on said transfer belt.

4. The apparatus of claim 1 wherein said image forming apparatus comprises a printer.

5. The apparatus of claim 1 wherein said home position indicator is selected from the group consisting of a notch in said transfer belt, a hole extending through said transfer belt, indicia printed on said transfer belt, indicia painted on said transfer belt, indicia bonded on said transfer belt, a magnetic device disposed on said transfer belt and an electrostatic device disposed on said transfer belt.

6. The apparatus of claim 1 wherein said at least one sensor is selected from the group consisting of an optical sensor, an indicia reader, a magnetic detector, and an electrostatic detector.

7. The apparatus of claim 2 wherein said variable speed motor is selected from the group consisting of a brushless D.C. motor with encoder feedback, a brush D.C. motor with encoder feedback, a stepper motor, and a stepper motor with encoder feedback.

8. An image forming apparatus for providing improved image registration, comprising:

a plurality of rollers;

a transfer belt disposed about said plurality of rollers for receiving an image disposed in at least two color planes;

a home position indicator associated with said transfer belt;

a memory storage device having calibration data stored thereon regarding said transfer belt, said calibration data being associated with said home position indicator;

at least one sensor disposed adjacent said transfer belt for sensing said home position indicator;

a motor for driving one of said rollers, said driven roller being a drive roller for said transfer belt; and a controller in communication with said sensor and said memory storage device, said controller responsive to said at least one sensor such that when said home position indicator is detected said controller determines a position of said transfer belt relative to said image as a function of said calibration data and determines to one of slow down, speed up, or leave unchanged a velocity of said transfer belt and increase, decrease, or leave unchanged a start of scan delay of one of said color planes of said image to thereby improve image registration on said transfer belt.

9. The apparatus of claim 8 further comprising:

a variable speed motor for driving said transfer belt.

10. The apparatus of claim 8 wherein said home position indicator is selected from the group consisting of a hole extending through said transfer belt, indicia printed on said transfer belt, indicia painted on said transfer belt, indicia bonded on said transfer belt, a magnetic device disposed on said transfer belt and an electrostatic device disposed on said transfer belt.

11. The apparatus of claim 8 wherein said at least one sensor is selected from the group consisting of an optical sensor, an indicia reader, a magnetic detector, and an electrostatic detector.

12. An image forming apparatus for providing printer transfer belt position correction comprising:

a plurality of rollers;

a transfer belt disposed about said plurality of rollers;

a non-volatile memory device capable of storing calibration data regarding said transfer belt, said calibration data being stored before installation of said transfer belt into said image forming apparatus;

a home position indicator associated with said transfer belt, said home position indicator selected from the group consisting of a hole extending through said transfer belt, indica printed on said transfer belt, indicia painted on said transfer belt, indicia bonded on said transfer belt, a magnetic device disposed on said transfer belt and an electrostatic device disposed on said transfer belt;

a first sensor and a second sensor for sensing said home position indicator, said first sensor and said second sensor selected from the group consisting of an optical sensor, an indicia reader, a magnetic detector, and an electrostatic detector;

a thermistor for sensing a temperature within said apparatus;

a variable speed motor for driving said transfer belt; and a controller in communication with said first sensor, said second sensor, said thermistor and said memory device, said controller being responsive to said first sensor, said second sensor, said thermistor and said calibration data to control said apparatus to correct for belt positioning errors, said controller relying on said calibration data to effectively control the belt positioning errors of said transfer belt without undergoing any belt calibration cycle that generates a test pattern.

13. A method of correcting transfer belt position within a printer comprising:

providing a transfer belt and a memory storage device in a transfer belt subassembly;

storing calibration data relating to characteristics of said transfer belt in said memory storage device;

thereafter, installing said transfer belt subassembly into a printer;

driving said transfer belt with a variable speed mechanism;

sensing a home position indicator of said belt with at least one sensor; and controlling said printer with a controller, said controller being in communication with said at least one sensor and said memory storage device, said controller responsive to said at least one sensor and said calibration data to control said printer so as to effectively correct for transfer belt positioning errors without undergoing any belt calibration cycle that generates a test pattern.

14. The method of claim 13 wherein said step of driving said transfer belt with a variable speed mechanism comprises the step of driving said transfer belt with a variable speed motor selected from the group consisting of a brushless D.C. motor with encoder feedback, a brush D.C. motor with encoder feedback, a stepper motor, and a stepper motor with encoder feedback.

15. The method of claim 13 wherein said step of sensing is selected from the group consisting of sensing a hole in said belt with an optical sensor, sensing indicia on said belt with an indicia reader, sensing a magnetic device on said belt with a magnetic detector, and sensing an electrostatic device on said belt with an electrostatic detector.

16. The method of claim 13 wherein said step of storing calibration data comprises storing data relating to an AC belt velocity.

17. The method of claim 13 wherein said step of storing calibration data comprises storing data relating to a DC belt velocity.

18. The method of claim 13 wherein said step of storing calibration data comprises storing data relating to a start-of-scan delay for each of a plurality of color stations disposed adjacent said transfer belt.

19. A method of correcting transfer belt position within a printer comprising:

providing a transfer belt subassembly including a transfer belt disposed about a plurality of rollers, and a memory storage device;

storing calibration data relating to characteristics of said transfer belt in said memory storage device, said calibration data comprising data relating to an AC belt velocity, data relating to a DC belt velocity, data relating to thermal conditions within said printer, and data relating to a start-of-scan delay for each of a plurality of color stations disposed adjacent said transfer belt;

thereafter, installing said transfer belt subassembly into said printer;

driving said transfer belt with a variable speed motor;

sensing a home position indicator of said belt with at least one sensor;

sensing a temperature of said subassembly with a thermal sensor; and controlling said printer with a controller, said controller in communication with said at least one sensor, said thermal sensor, and said memory storage device, said controller responsive to said at least one sensor, said thermal sensor and said calibration data to control said printer to collect for transfer belt positioning errors.

20. The method as recited in claim 19, wherein said calibration data has been predetermined during a measurement and characterization procedure of said transfer belt subassembly that takes place at time of manufacture, before said step of storing calibration data in said memory storage device.

21. A method for improving image registration within an image forming apparatus, said method comprising:

at time of manufacture, testing a transfer belt subassembly of an image forming apparatus to obtain calibration data related to image registration characteristics of said transfer belt, and storing said calibration data into a non-volatile memory device that is provided within said transfer belt subassembly;

thereafter, providing an image forming apparatus having a controller, and installing said transfer belt subassembly into said image forming apparatus; and at time of use, controlling said transfer belt utilizing said stored calibration data and signals from at least one sensor to control positioning of said transfer belt, said controller relying on said calibration data to effectively correct image registration errors without undergoing any belt calibration cycle to generate a test pattern.

22. The method as recited in claim 21, wherein the step of testing a transfer belt subassembly comprises: placing said transfer belt subassembly into a test fixture and causing said transfer belt subassembly to operate using simulated loads, while measuring the performance of said transfer belt subassembly and characterizing its performance to generate said calibration data for that individual transfer belt subassembly.

23. The method as recited in claim 21, wherein the step of controlling said transfer belt comprises: driving said transfer belt subassembly with a variable speed mechanism, sensing a home position indicator of said belt with said at least one sensor; and controlling positioning of said transfer belt subassembly with respect to said home position indicator utilizing at least a portion of said calibration data that is characterized relative to said home position indicator.

24. The method as recited in claim 21, wherein the step of effectively correcting image registration comprises: utilizing said calibration data, aligning a plurality of color plane images upon said transfer belt subassembly in a manner so as to correct for positioning errors that otherwise would occur during image registration of said color planes.

* * * * *